US012767314B2

(12) United States Patent
Giannis et al.

(10) Patent No.: US 12,767,314 B2
(45) Date of Patent: Oct. 20, 2026

(54) PROPULSION SYSTEM ARRANGEMENT AND METHOD HAVING FLUID CIRCUITS FOR COOLING AND LUBRICATION OF MOTOR AND CLUTCH

(71) Applicant: Caterpillar Inc., Peoria, IL (US)

(72) Inventors: Matthew E. Giannis, Lisle, IL (US); Joshua W. Dorothy, Dunlap, IL (US); Michael J. Barngrover, Brimfield, IL (US); John M. Seipold, Peoria, IL (US); Mark Allen Garety, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 198 days.

(21) Appl. No.: 18/295,423

(22) Filed: Apr. 4, 2023

(65) Prior Publication Data

US 2024/0336343 A1 Oct. 10, 2024

(51) Int. Cl.
*B63H 23/12* (2006.01)
*B63H 21/14* (2006.01)
(Continued)

(52) U.S. Cl.
CPC ..... *B63H 23/12* (2013.01); *B63H 21/14* (2013.01); *B63H 21/383* (2013.01);
(Continued)

(58) Field of Classification Search
USPC ..... 417/410.1
See application file for complete search history.

(56) References Cited

U.S. PATENT DOCUMENTS 2,325,647 A * 8/1943 Adamson ..... F16H 57/0415 184/104.1
2,687,784 A * 8/1954 Klackner ..... F16N 39/02 184/104.1
(Continued)

FOREIGN PATENT DOCUMENTS

CN 205395988 U 7/2016
CN 111279102 A * 6/2020 ..... F16H 61/0206
(Continued)

OTHER PUBLICATIONS

Machine Translation JP-2012-106599 Motonaga (Obtained from USPTO Search) (Year: 2024).*
(Continued)

*Primary Examiner* — Dominick L Plakkoottam
*Assistant Examiner* — Geoffrey S Lee
(74) *Attorney, Agent, or Firm* — Brannon Sowers & Cracraft

(57) ABSTRACT

A propulsion system includes an electric motor assembly having an electric motor, a driveshaft, and a disconnect clutch. The disconnect clutch is structured to couple the driveshaft to an engine output shaft. The propulsion system further includes a fluid system having a cooling and lubrication fluid circuit fluidly connected to a first pump, and a clutch actuation fluid circuit fluidly connected to a second pump. The cooling and lubrication fluid circuit is fluidly connected to the clutch actuation fluid circuit via at least one of respective pump outgoing conduits from the first pump and the second pump or respective pump supply conduits to the first pump and the second pump. Related operating methodology is also disclosed.

16 Claims, 7 Drawing Sheets

(51) Int. Cl.
*B63H 21/38* (2006.01)
*B63H 23/30* (2006.01)

(52) U.S. Cl.
CPC ..... *B63H 21/386* (2013.01); *B63H 23/30* (2013.01); *B63H 2023/305* (2013.01)

(56) References Cited

U.S. PATENT DOCUMENTS

| | | | | |
|---|---|---|---|---|
| 3,344,679 | A * | 10/1967 | Zeller | F16H 59/045 74/360 |
| 4,037,687 | A * | 7/1977 | Krutz | F16H 57/0434 184/6.4 |
| 6,513,609 | B2 * | 2/2003 | Hasegawa | F16H 57/0489 903/952 |
| 6,986,727 | B2 * | 1/2006 | Kuras | B60W 10/08 477/4 |
| 7,727,099 | B2 * | 6/2010 | Kasuya | F16H 3/728 903/952 |
| 7,775,338 | B2 * | 8/2010 | Yoshida | F16H 57/0434 184/6.12 |
| 8,042,331 | B2 * | 10/2011 | Schultz | F16H 61/0025 60/449 |
| 8,498,790 | B2 * | 7/2013 | Fujiwara | F16H 61/0021 701/66 |
| 9,127,765 | B2 | 9/2015 | Eto et al. | |
| 9,862,470 | B2 | 1/2018 | Davis et al. | |
| 10,023,184 | B2 * | 7/2018 | Hartz | B60W 20/40 |
| 10,837,547 | B2 * | 11/2020 | Shimizu | B60K 6/543 |
| 11,235,848 | B1 | 2/2022 | Jaszewski et al. | |
| 2002/0091034 | A1 * | 7/2002 | Nakamori | B60K 6/485 477/3 |
| 2003/0109970 | A1 * | 6/2003 | Nakamori | F16H 61/0031 903/903 |
| 2006/0120876 | A1 * | 6/2006 | Kitano | F16H 61/0031 417/42 |
| 2009/0096307 | A1 | 4/2009 | Tsutsumi et al. | |
| 2009/0253546 | A1 * | 10/2009 | Foster | B60K 6/445 903/930 |
| 2010/0263951 | A1 * | 10/2010 | Hayashi | B60W 30/18054 180/65.275 |
| 2011/0017015 | A1 * | 1/2011 | Cimatti | F16H 61/0028 903/909 |
| 2012/0063922 | A1 * | 3/2012 | Sano | F16H 61/682 417/44.1 |
| 2012/0108385 | A1 * | 5/2012 | Sano | B60W 10/08 180/65.265 |
| 2012/0244012 | A1 * | 9/2012 | Kigure | F04B 49/06 417/42 |
| 2016/0052379 | A1 * | 2/2016 | Inoue | F16H 57/0441 903/902 |
| 2017/0210315 | A1 * | 7/2017 | Nakajima | F16N 7/385 |
| 2017/0282904 | A1 | 10/2017 | Morita | |
| 2018/0066655 | A1 * | 3/2018 | Kowalski | F04C 2/102 |
| 2018/0119800 | A1 * | 5/2018 | Shimizu | B60W 20/00 |
| 2021/0180686 | A1 * | 6/2021 | Novak | F16H 61/00 |
| 2021/0229543 | A1 | 7/2021 | Trinkenschuh et al. | |

FOREIGN PATENT DOCUMENTS

| | | | | |
|---|---|---|---|---|
| CN | 217762005 | U | 11/2022 | |
| DE | 10318152 | B4 * | 7/2018 | F16H 61/0031 |
| EP | 2667053 | A2 * | 11/2013 | B60K 6/48 |
| EP | 2667053 | A3 | 12/2013 | |
| EP | 2930388 | A2 * | 10/2015 | F16D 48/02 |
| JP | 2012106599 | A * | 6/2012 | |
| SE | 514363 | C2 | 2/2001 | |
| WO | 2015048960 | A2 | 4/2015 | |
| WO | 2020043235 | A1 | 3/2020 | |

OTHER PUBLICATIONS

Machine Translation of EP2667053 Ruehle (Obtained from USPTO Search) (Year: 2024).*

Machine Translation of EP2930388 Heyer (Obtained from USPTO Search) (Year: 2024).*

Definition of Torque (Obtained from https://www.merriam-webster.com/dictionary/torque Sep. 30, 2024) (Year: 2024).*

Definition of Onboard (Obtained from tttps://www.merriam-webster.com/dictionary/onboard, Dec. 10, 2024) (Year: 2024).*

Machine Translation CN-111279102-A, Novak (Obtained from USPTO Search) (Year: 2026).*

Machine Translation DE-10318152-B4, Panagiotis (Obtained from USPTO Search) (Year: 2026).*

Joachim Hoffmann J., Kimmig, K., Baumgartner, A., Erdmann, K., Haas, W., Wagner, P., The Top 3 Of P2. Space, Space, Space. Schaeffler Colloquium "Mobility for tomorrow," 2018, 23 pages.

Written Opinion and International Search Report for Int'l. Patent Appln. No. PCT/US2024/017970, mailed Jun. 28, 2024 (42 pgs).

* cited by examiner

PROPULSION SYSTEM ARRANGEMENT AND METHOD HAVING FLUID CIRCUITS FOR COOLING AND LUBRICATION OF MOTOR AND CLUTCH

TECHNICAL FIELD

The present disclosure relates generally to a propulsion system, and more particularly to interconnecting a cooling and lubrication fluid circuit and a clutch actuation fluid circuit in a propulsion system.

BACKGROUND

A great many different propulsion system configurations are known for mobile machines, including land vehicles and marine vessels. For decades, propulsion systems were conventionally based around combustion engines including diesel and/or natural gas engines, gasoline engines, and even gas turbine engines. Electric propulsion systems have also been widely adopted for many years. More recently, various hybrid propulsion systems employing both combustion engines and electric power have seen considerable commercial success.

Current market offerings for so-called hybrid systems, especially in the marine vessel propulsion space, can often require an end user to integrate multiple disparate systems from different suppliers. As a result, end users are commonly required to identify, source, and assemble different aspects of the machinery and purchase or even customize parts. For example, individual parts of a propulsion system can also often require their own secondary systems, such as fluid supplies, cooling systems, and computer control units. In addition to the challenges of integration, installing hybrid systems concocted from different suppliers inevitably requires more than an ideal amount of space. One known hybrid population system is described in U.S. Pat. No. 6,986,727 to Kuras et al. The art provides ample opportunity for improvements and development of alternative strategies.

SUMMARY OF THE INVENTION

In one aspect, a propulsion system includes an electric motor assembly having an electric motor, a driveshaft, and a disconnect clutch structured to couple the driveshaft to an engine output shaft. The propulsion system further includes a fluid system having a first pump, a cooling and lubrication fluid circuit fluidly connected to the first pump, a second pump and a clutch actuation fluid circuit fluidly connected to the second pump. The fluid system further includes an interconnect fluidly connecting the cooling and lubrication fluid circuit to the clutch actuation fluid circuit.

In another aspect, a method of cooling and lubricating a propulsion system includes applying a torque to a driveshaft of an electric motor via a disconnect clutch engaged between the electric motor and an engine, and disengaging the disconnect clutch via varying a pressure of a fluid for actuating the disconnect clutch supplied from an actuation fluid pump. The method further includes applying a torque to the driveshaft via energizing stator coils in the electric motor while the disconnect clutch is disengaged, and operating a cooling and lubrication fluid pump via the rotation of the driveshaft both while the disconnect clutch is engaged and while the disconnect clutch is disengaged. The method still further includes supplying fluid for cooling and lubrication to the electric motor and to the disconnect clutch based on the operating the cooling and lubrication fluid pump.

In still another aspect, a propulsion system includes an electric motor assembly having a housing, an electric motor having a driveshaft, and a disconnect clutch. The propulsion system further includes a fluid system having a cooling and lubrication fluid circuit structured to fluidly connect to a first pump, and a clutch actuation fluid circuit structured to fluidly connect to a second pump. The cooling and lubrication fluid circuit includes a pump outgoing conduit arranged to supply cooling and lubrication fluid from the first pump into the housing, and a pump supply conduit. The clutch actuation fluid circuit includes a pump outgoing conduit arranged to supply clutch actuation fluid from the second pump into the housing, and a pump supply conduit. The cooling and lubrication circuit is fluidly connected to the clutch actuation fluid circuit via at least one of the respective pump outgoing conduits or the respective pump supply conduits.

DETAILED DESCRIPTION

Figure 1:
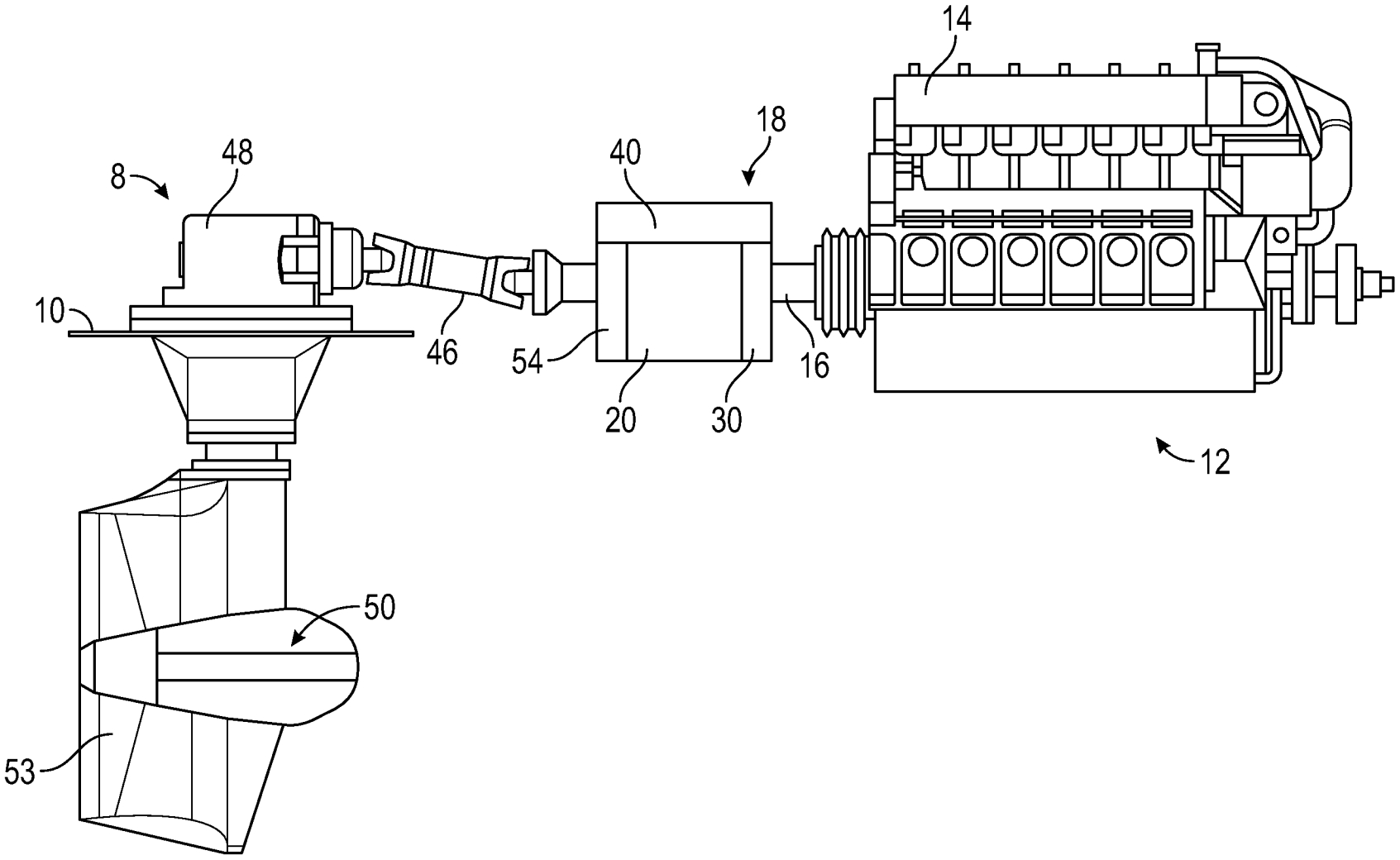
FIG. 1 is a diagrammatic view of a machine having a propulsion system, according to one embodiment.

Referring to FIG. 1, there is shown a machine 8 according to one embodiment, including a frame 10 and a propulsion system 12 supported on frame 10. Machine 8 includes a marine vessel in some embodiments, such that frame 10 forms or supports a deck or hull of the marine vessel. Propulsion system 12 includes a combustion engine 14 having an engine output shaft 16. Engine 14 may include a direct-injected compression-ignition diesel engine having a plurality of combustion cylinders. In other implementations different engine configurations and operating and/or fueling and ignition strategies could be employed.

Propulsion system 12 may further include an electric motor assembly 18 having an electric motor 20, a hydraulically-actuated disconnect clutch 30, and a takeoff geartrain 54. Electric motor assembly 18 further includes a fluid system 40. Electric motor assembly 18 may be coupled to a drive coupling 46 that rotates a final drive 50. Operating final drive 50 by way of drive coupling 46 and a gearbox 48 may include operating final drive 50 coupled to a propeller 53 in a marine vessel application. In other applications final drive 50 could be coupled to one or more ground-engaging wheels or tracks, for example. As will be further apparent from the following description, the present disclosure contemplates operating propulsion system 18 in various different modes including a motor-only mode, an engine-only mode, and a hybrid mode. Fluid system 40 may be structured to provide cooling and lubrication to electric motor assembly 18, including to electric motor 20 and to disconnect clutch 30 in each of the engine-only mode, motor-only mode, and hybrid mode, the features and significance of which will be further apparent from the following description.

Figure 2:
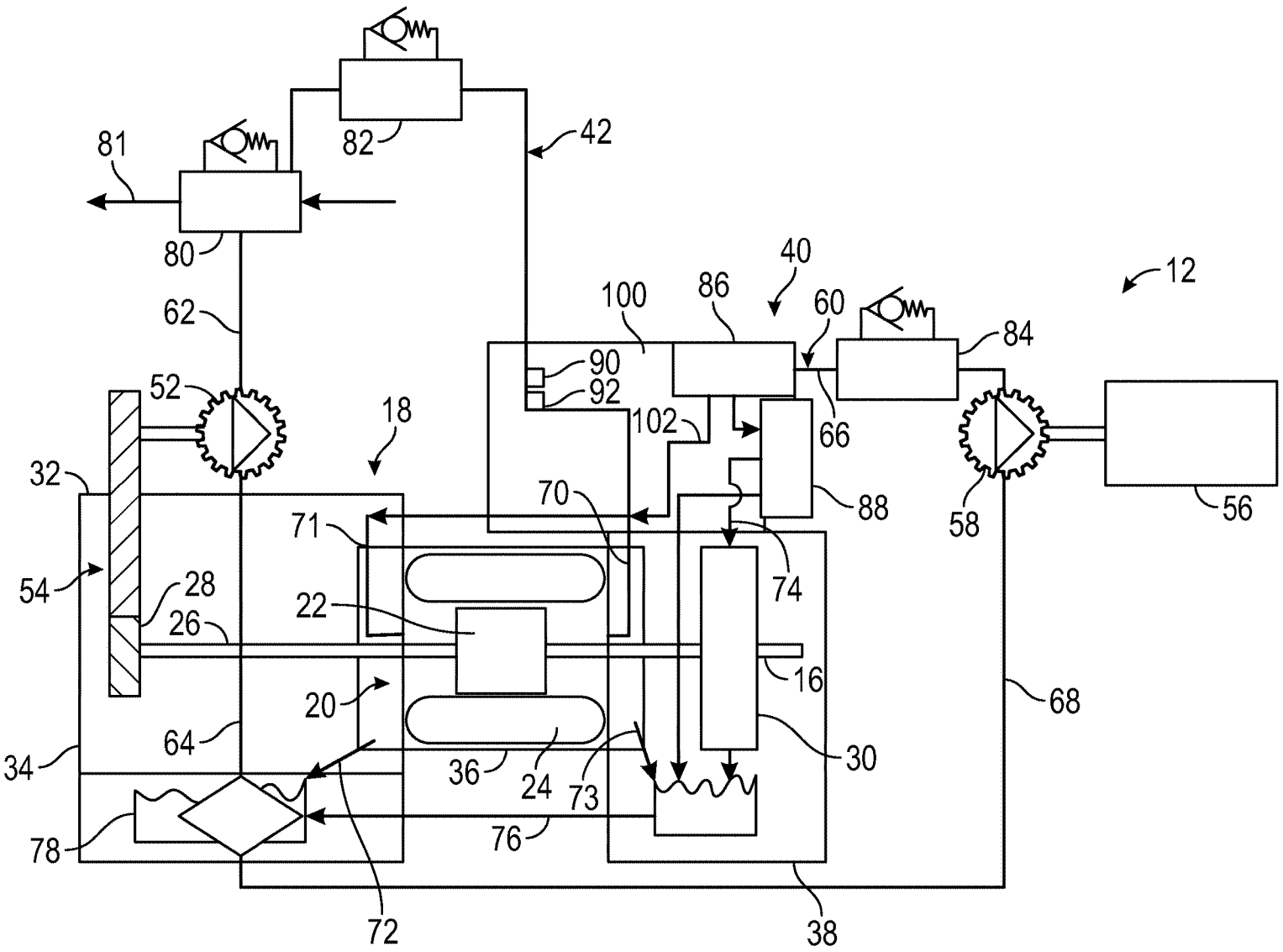
FIG. 2 is a schematic illustration of a propulsion system, according to one embodiment.

Referring also now to FIG. 2, electric motor 20 includes a rotor 22 and a stator 24, a driveshaft 26, and an output gear 28 fixed to rotate with driveshaft 26. Disconnect clutch 30 is positioned operably between driveshaft 26 and engine output shaft 16. Disconnect clutch 30 may be adjustable, via varying a pressure of a clutch actuation fluid, from a disengaged state to an engaged state to couple driveshaft 26 to engine output shaft 16. Electric motor assembly 18 may further include a common housing 32 having a plurality of attached housing components 34, 36, 38 together positioned around electric motor 20, takeoff geartrain 54, and disconnect clutch 30.

In an embodiment, common housing 32 includes a clutch housing component 38 positioned around disconnect clutch 30, a geartrain housing component 34 positioned around output gear 28, and a motor housing component 36 attached between geartrain housing component 34 and clutch housing component 38. Output gear 28 may be coupled to takeoff geartrain 54 positioned at least partially in common housing 32, in particular positioned at least partially in geartrain housing component 34.

Fluid system 40 may further include a fluid circuit 42 for cooling and lubrication of at least one of electric motor 20 or disconnect clutch 30. Fluid system 40 may also include a cooling and lubrication pump or first pump 52 rotated via takeoff geartrain 54 and mounted on common housing 32. Fluid system 40 may also include a clutch actuation pump or second pump 58 that is rotated by way of an engine geartrain 56 of engine 14. First pump 52 may include a low-pressure cooling and lubrication pump that is mounted onboard electric motor assembly 18. Second pump 58 may include a high-pressure clutch actuation pump mounted offboard electric motor assembly 18, such as mounted to an engine housing or other supporting structure associated with, or in proximity to, engine 14.

Common housing 32 may further have formed therein at least one cooling and lubrication fluid supply port, including in the illustrated embodiment a first cooling and lubrication fluid supply port 70 and a second cooling and lubrication fluid supply port 71. Common housing 32 may further include a first cooling and lubrication fluid drain 72 and a second cooling and lubrication fluid drain 73 formed therein. In the illustrated embodiment, first cooling and lubrication fluid supply port 70 is formed in clutch housing component 38 and second cooling and lubrication fluid supply port 71 is formed in geartrain housing component 34. A cooling and lubrication fluid, such as oil, may thus be conveyed into motor housing component 36 from each of clutch housing component 38 and geartrain housing component 34. First cooling and lubrication fluid drain 72 and second cooling and lubrication fluid drain 73 may be formed in geartrain housing component 34 and clutch housing component 38, respectively. Thus, cooling and lubrication fluid can drain from motor housing component 36 into geartrain housing component 34 and clutch housing component 38. Common housing 32 may still further include a clutch actuation fluid supply port 74 and a clutch actuation fluid drain 76 formed therein. A clutch actuation fluid and the cooling and lubrication fluid may be the same fluid, with the configuration of fluid system 20 enabling separated flows of the fluid to first pump 52 and second pump 58, and merged flows of the fluid returned for recirculation. Fluid system 40 may further include a common fluid sump 78 mounted on common housing 32 that receives combined flows of the drained fluid used in cooling and lubrication and clutch actuation.

As noted above, fluid system 40 may include fluid circuit 42. Fluid system 40 may also include a clutch actuation fluid circuit 60. Cooling and lubrication circuit 42 is fluidly connected to first pump 52 such that first pump 52 is arranged in cooling and lubrication circuit 42, and clutch actuation fluid circuit 60 is fluidly connected to second pump 58 such that second pump 58 is arranged in actuation fluid circuit 60. Fluid system 40 may also include an interconnect 102 formed, for example, in a valve block 100 mounted on common housing 32, fluidly connecting cooling and lubrication fluid circuit 42 to clutch actuation fluid circuit 60.

Fluid system 40 may further include a cooler 80 arranged to receive an outgoing flow of fluid from first pump 52 to be fed into common housing 32 by way of a pump outgoing conduit 62. A coolant conduit 81 may carry coolant for cooling the fluid conveyed through pump outgoing conduit 62. Fluid system 40 may also include a filter 82 filtering fluid having been cooled in cooler 80. A pressure sensor 90 and a temperature sensor 92 may be positioned on or in valve block 100 to monitor a pressure and a temperature of fluid conveyed through cooling and lubrication circuit 42. A pump supply conduit 64 includes a suction conduit and conveys fluid from common fluid sump 78 to first pump 52. Another pump outgoing conduit 66 receives fluid pumped by second pump 58 to be fed into common housing 32 and conveys the same through clutch actuation fluid circuit 60 to valve block 100, typically by way of another filter 84. A pump supply conduit 68 includes a suction conduit that conveys fluid from common fluid sump 78 to second pump 58. Cooling and lubrication fluid circuit 42 may be fluidly connected to clutch actuation fluid circuit 60 via at least one of the respective pump outgoing conduits 62 and 66 or the respective pump supply conduits 64 and 68. In the illustrated embodiment, pump outgoing conduits 62 and 66 fluidly connect circuits 42 and 60 via interconnect 102 in valve block 100, and pump supply conduits 64 and 68 fluidly connect circuits 42 and 60 via common fluid sump 78. A clutch control valve, such as a so-called ICTG valve, is shown at 88 and may be electrically actuated to vary a pressure of clutch actuation fluid supplied to clutch 30 for engaging and disengaging the same.

Figure 3:
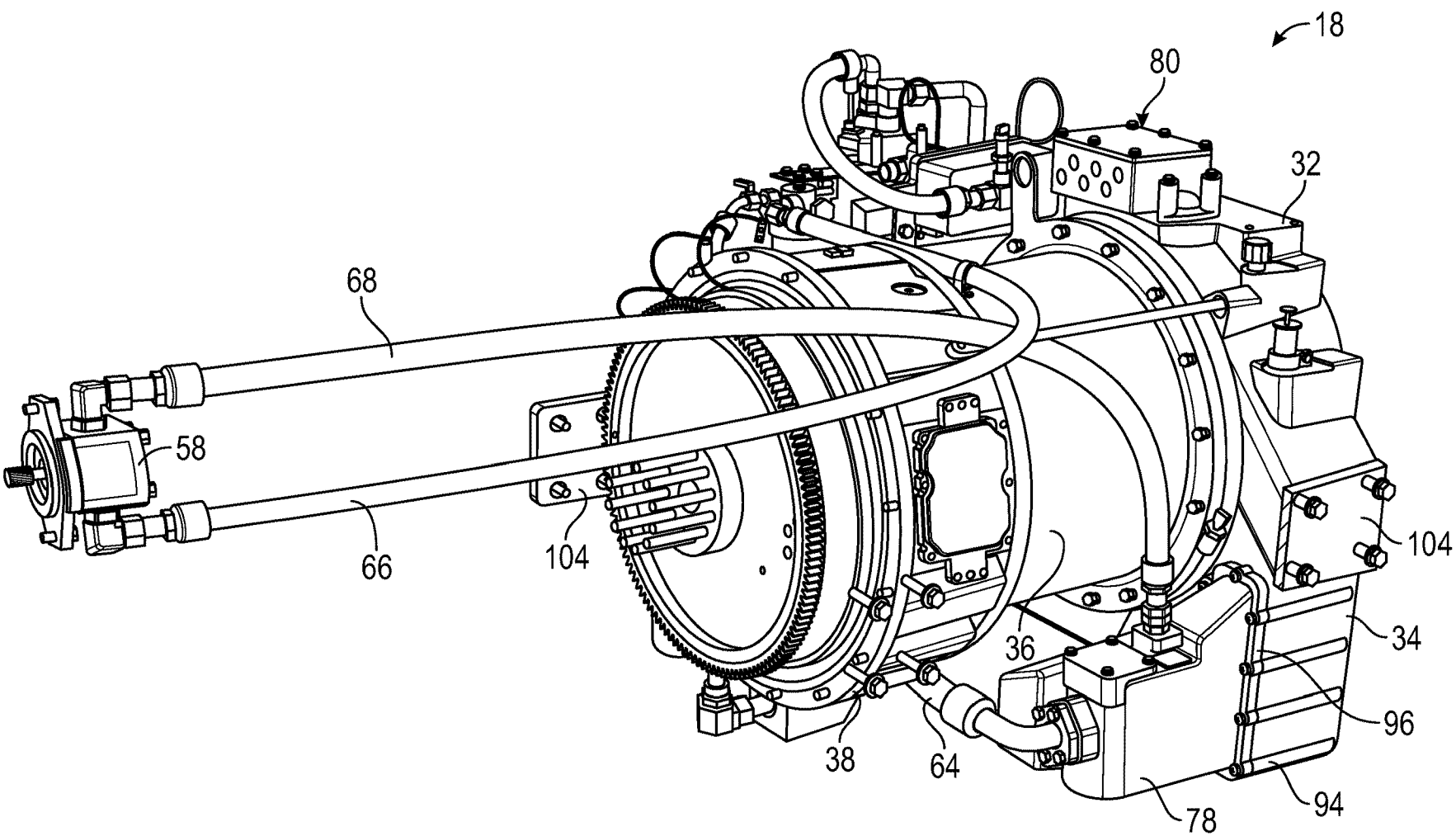
FIG. 3 is a diagrammatic view of an electric motor assembly for use in a propulsion system, according to one embodiment.
Figure 4:
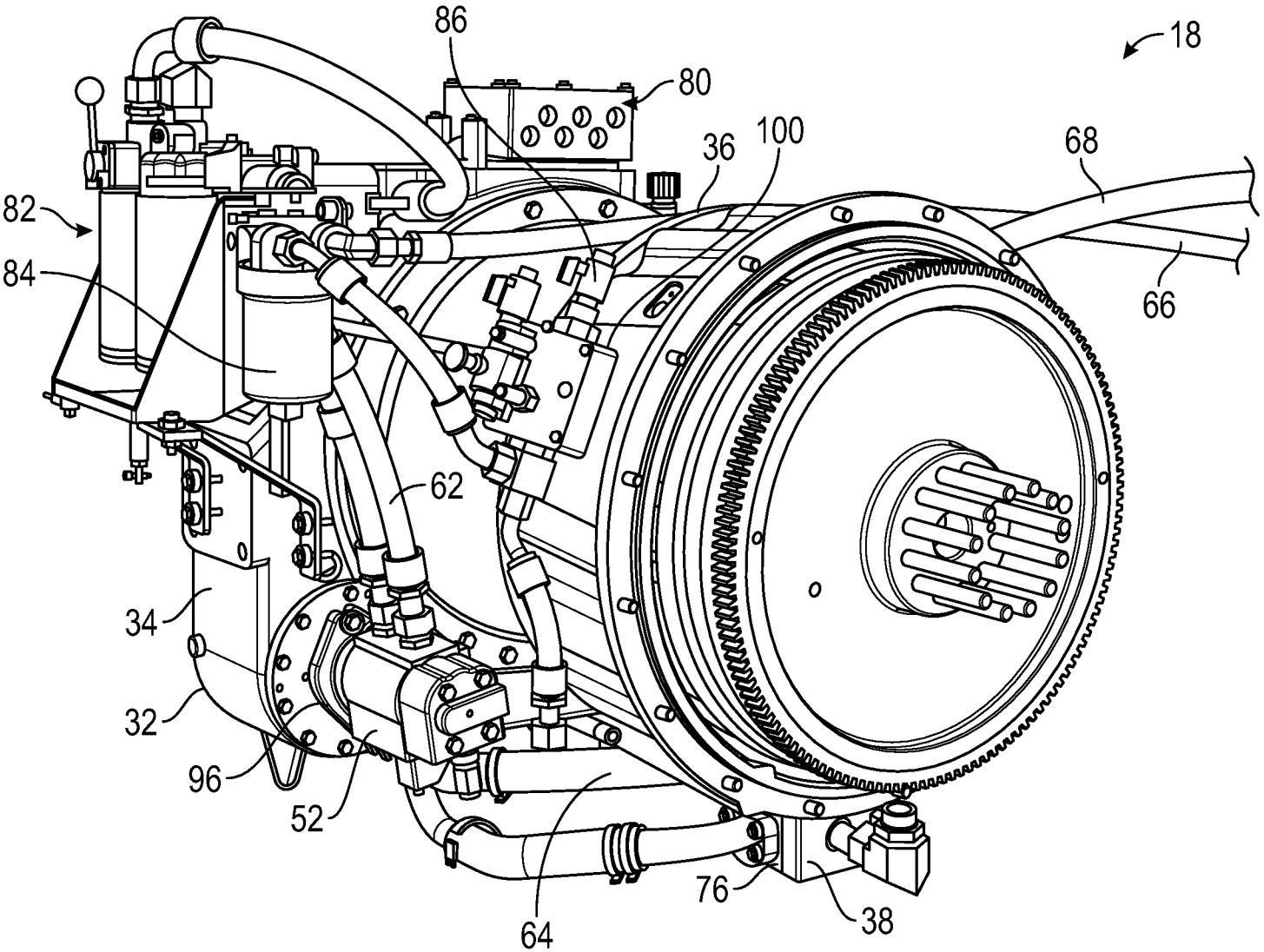
FIG. 4 is another diagrammatic view of the electric motor assembly.

Referring also now to FIGS. 3 and 4, there are shown further features and details of an example embodiment of electric motor assembly 18. As shown in FIG. 3, common housing 32 may be attached to a first mounting bar 104 and a second mounting bar 104 attached at a first side and a second side, respectively, of common housing 32. Mounting bars 104 may be used for positioning and supporting electric motor assembly 18 onboard a machine such as a marine vessel as discussed herein. In FIG. 3, second pump 58 is shown as it might appear offboard common housing 32 to be positioned in proximity to engine 14 and coupled to engine geartrain 56. FIG. 4 shows first pump 52 mounted on common housing 32. In the illustrated embodiment mounting bars 104 attach to geartrain housing component 34, and first pump 52 is also mounted on geartrain housing component 34. Other embodiments could include different arrangements.

As also depicted in FIG. 3 common fluid sump 78 is mounted on geartrain housing component 34 upon a sump mounting face 96. FIG. 3 also shows a downwardly depending fluid collection portion 94 of geartrain housing component 34 positioned to receive cooling and lubrication fluid drained through common housing 32 under the force of gravity. Sump mounting face 96 is formed at least in part upon fluid collection portion 94. Each of pump supply conduit 64 and pump supply conduit 68 can be seen to be fluidly connected to common fluid sump 78. Common fluid sump 78 may be equipped with an internal screen filter or the like for filtering fluid in cooling and lubrication fluid circuit 42 and clutch actuation fluid circuit 60. FIGS. 3 and 4 also illustrate pump outgoing conduits 62 and 66 arranged to provide pumped fluid from the respective pumps into common housing 32 as further discussed herein.

Figure 5:
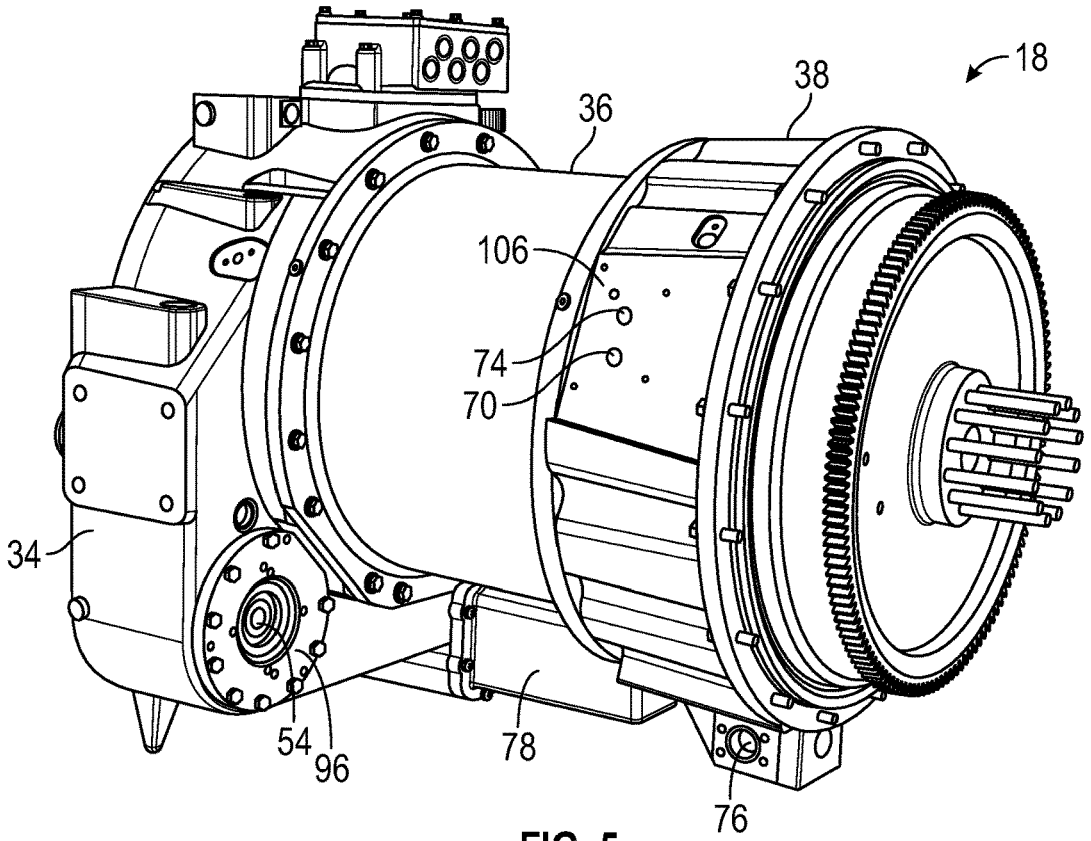
FIG. 5 is yet another diagrammatic view of the electric motor assembly.
Figure 6:
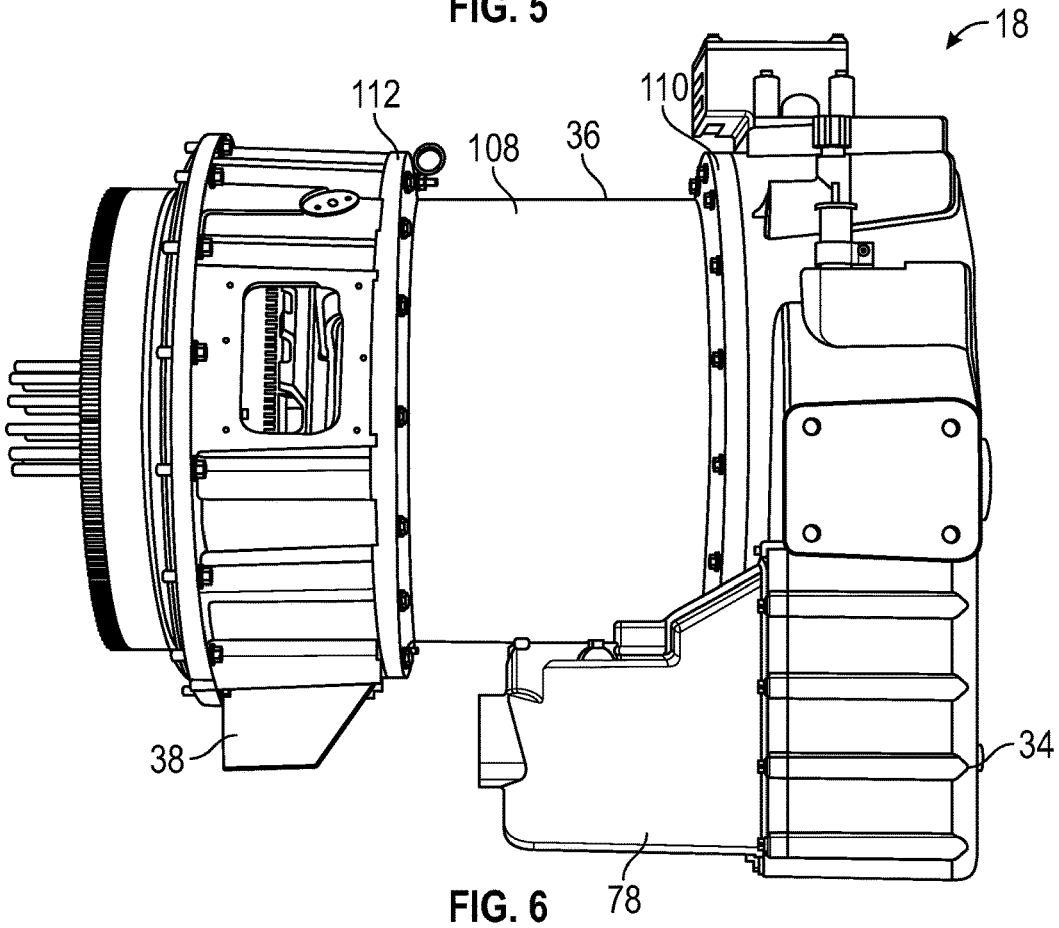
FIG. 6 is yet another diagrammatic view of the electric motor assembly.
Figure 7:
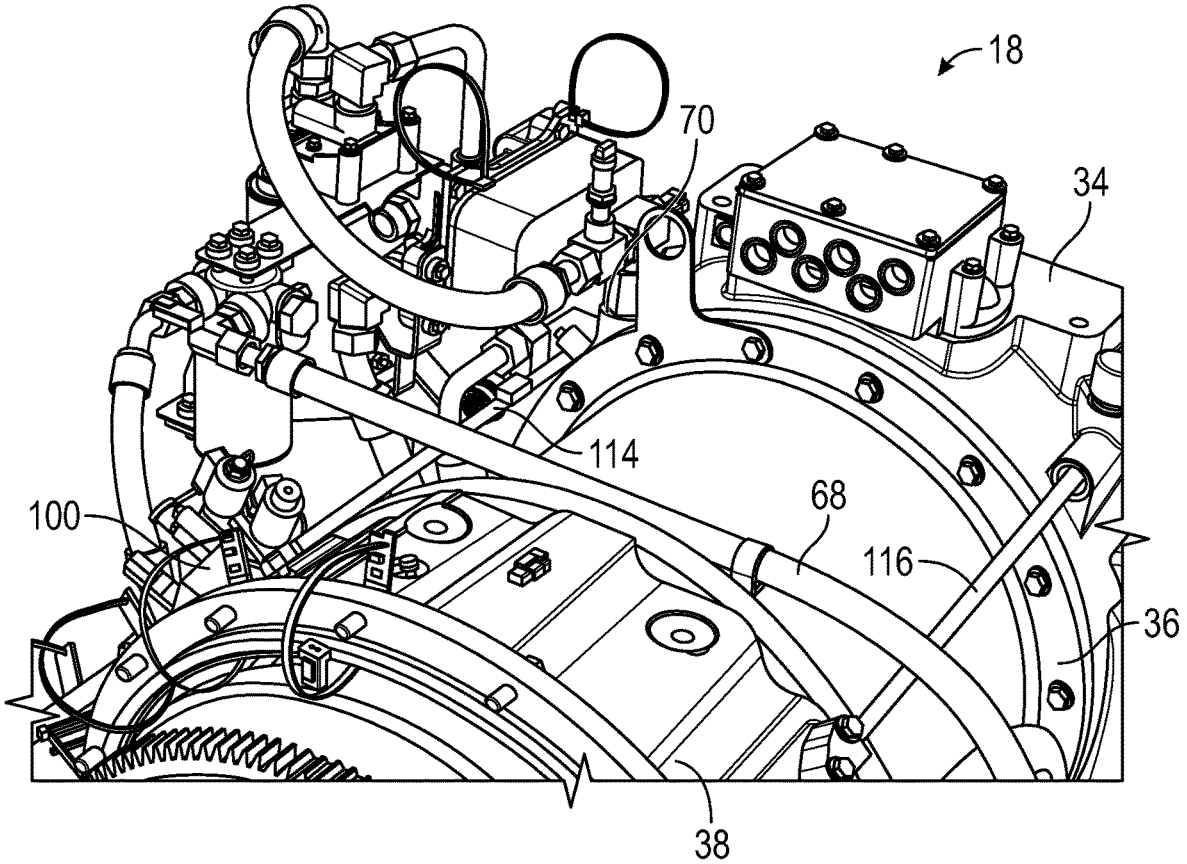
FIG. 7 is yet another diagrammatic view of the electric motor assembly.

Referring now also to FIGS. 5, 6, and 7, there can be seen still further details of electric motor assembly 18. As shown in FIG. 5, clutch housing component 38 may have a valve block mounting face 106 formed thereon. Cooling and lubrication fluid supply port 70 and clutch actuation fluid supply port 74 are shown formed in valve block mounting face 106. A pump mounting face 96 is formed on geartrain housing component 34. Takeoff geartrain 54 is visible surrounded by pump mounting face 96.

As illustrated in FIG. 6 motor housing component 36 may include a first end flange 110 bolted to geartrain housing component 34, and a second end flange 112 bolted to clutch housing component 38. Motor housing component 36 may also include a cylindrical center section 108 extending from first end flange 110 to second end flange 112. In view of the present description and accompanying illustrations it can be appreciated that components of secondary systems may be mounted principally or entirely on geartrain housing component 34 or clutch housing component 38. Such a strategy allows motor housing component 36 to be selected from a range of different motor housing components, depending upon the application, and used with the same clutch housing component 38 and geartrain housing component 34. Various modifications to electric motor assembly 18 can be accommodated in this way by selecting a suitable motor housing component 36. For example, an electric motor of a relatively larger size can be positioned in a relatively larger motor housing component, whereas an electric motor of a smaller size can be arranged in a relatively smaller motor housing component. In this way, variations in the internal geometry, size, etc. of an electric motor can be accommodated by a variable size motor housing attached between the same clutch and geartrain housing components.

Focusing now on FIG. 7, there can be seen two externally mounted fluid conduits 114 and 116 that convey fluid from geartrain housing component 34 to clutch housing component 38. Fluid conduit 116 may supply cooling and lubrication fluid directly from geartrain housing component 34 to clutch housing component 38, and fluid conduit 114 may supply cooling and lubrication fluid directly from geartrain housing component 34 to valve block 100. Fluid conduit 114 is fluidly connected between first pump 52 and valve block 100. Cooling and lubrication fluid pumped by way of first pump 52 in cooling and lubrication circuit 42 can be conveyed into geartrain housing component 34 and then conveyed by way of external conduits 114 and 116 across or past motor housing component 36 to clutch housing component 38. As discussed above, cooling and lubrication fluid can be supplied into motor housing component 36 from the respective geartrain housing component 34 and clutch housing component 38. It will be recalled motor housing component 36 may have a range of sizes depending upon the application. Accordingly, conduits 114 and 116 may also have a variable size, with longer conduits used for a longer motor housing and shorter conduits used for a shorter motor housing. By attaching one or more conduits 114, 116 externally to geartrain housing component 34 and clutch housing component 38 the variable or selectable size of motor housing component 36 is facilitated without requirements for establishing internal fluid connections for conveyance of cooling and lubrication fluid. In this embodiment, cooling and lubrication fluid is supplied from geartrain housing component 34 to clutch housing component 38. In other embodiments a reverse pattern of fluid flow might be used to supply fluid from clutch housing component 38 to geartrain housing component 34. Bidirectional flow of cooling and lubrication fluid between geartrain housing component 34 and clutch housing component 38 would also be within the scope of the present disclosure.

Figure 8:
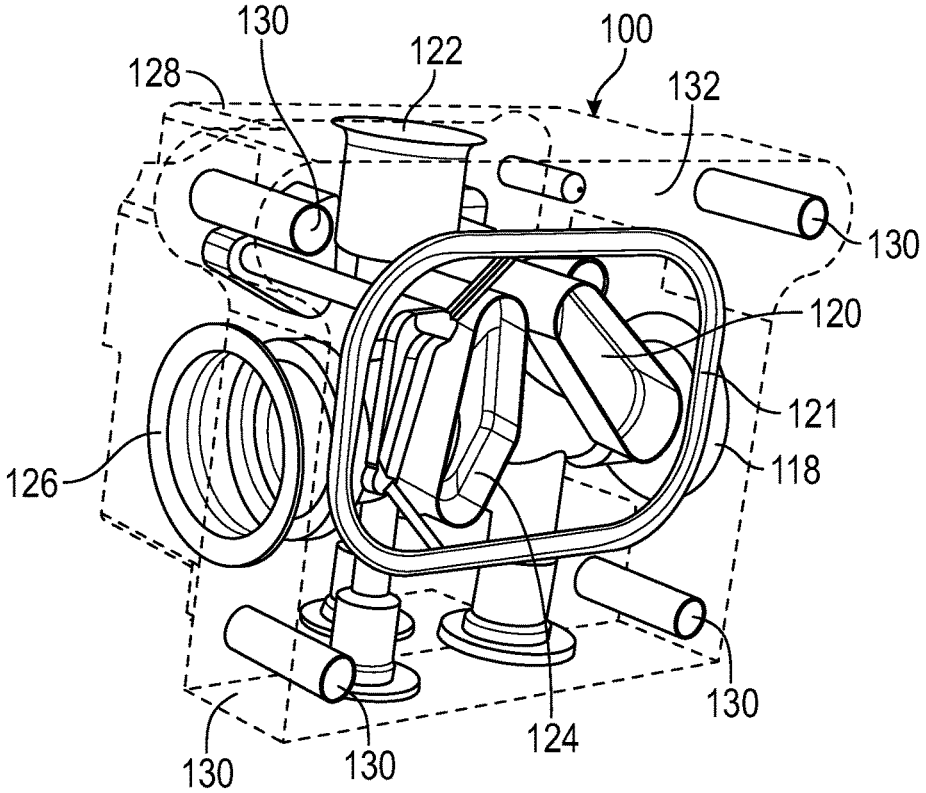
FIG. 8 is a diagrammatic view of a valve block, according to one embodiment.
Figure 9:
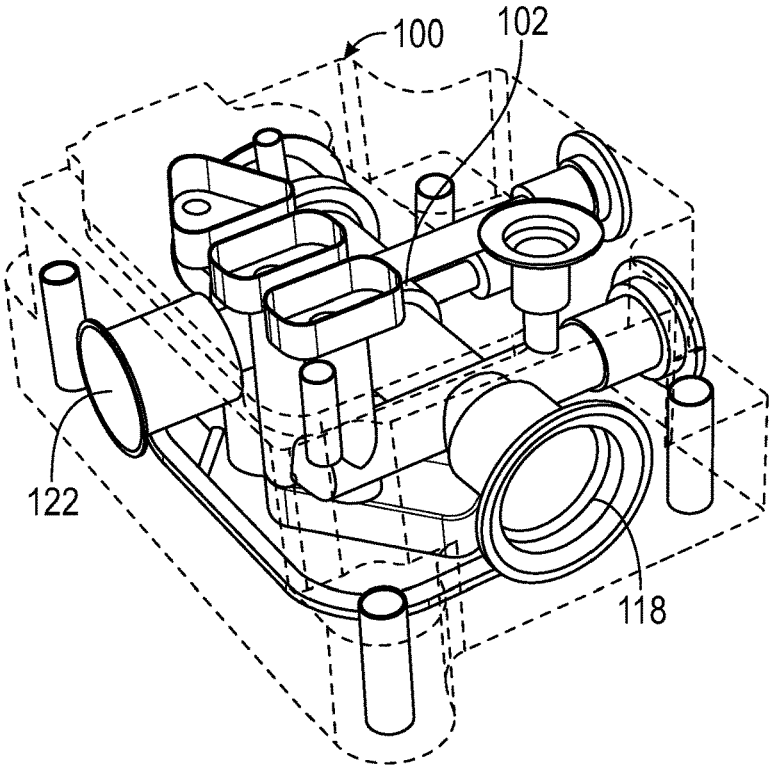
FIG. 9 is another diagrammatic view of the valve block.

Referring also now to FIGS. 8 and 9, there are shown different views of valve block 100. Valve block 100 includes a block body 128 having a contact face 132 structured to be positioned against valve block mounting face 106. Threaded bolting holes 130 extend through block body 128 for bolting valve block 100 to clutch housing component 38. A seal groove 121 is formed in contact face 132 to receive a seal to fluidly seal around a high-pressure outlet 120 for conveying clutch actuation fluid to port 74 and a low pressure outlet 124 for conveying cooling and lubrication fluid to port 70.

It will be recalled interconnect 102 may fluidly connect cooling and lubrication fluid circuit 42 to clutch actuation fluid circuit 60. Interconnect 102 may be formed in valve block 100, although it should be appreciated that other locations for interconnecting the respective fluid circuits are contemplated, such as within common housing 32 or even between external conduits in fluid system 20. In the illustrated embodiment, a high-pressure inlet 118 forms part of clutch actuation fluid circuit 60 and receives clutch actuation fluid pumped by second pump 58. A low-pressure inlet 122 forms part of cooling and lubrication fluid circuit 42 and receives cooling and lubrication fluid pumped by first pump 52. Within valve block 100 interconnect 102 is formed by a passage that fluidly connects high-pressure inlet 118 to low pressure inlet 122.

Fluid system 40 may also include a pressure relief valve 86. Pressure relief valve 86 may be configured to open in response to excess pressure in clutch actuation fluid circuit 60 to permit relieving the excess pressure, for example, to port 70. When clutch actuation fluid pressure drops, such as when engine 14 is shut down and second pump 58 turned off, some fluid from cooling and lubrication fluid circuit 42 can flow by way of interconnect 102 into the high-pressure side of fluid system 20, providing cooling and lubrication fluid to port 74 and thus at least some cooling and lubrication fluid to clutch 30. As a result, even when clutch 30 is disengaged and no flow of high-pressure clutch actuation fluid provided clutch 30 still sees some cooling and lubrication fluid flow.

INDUSTRIAL APPLICABILITY

Figure 10:
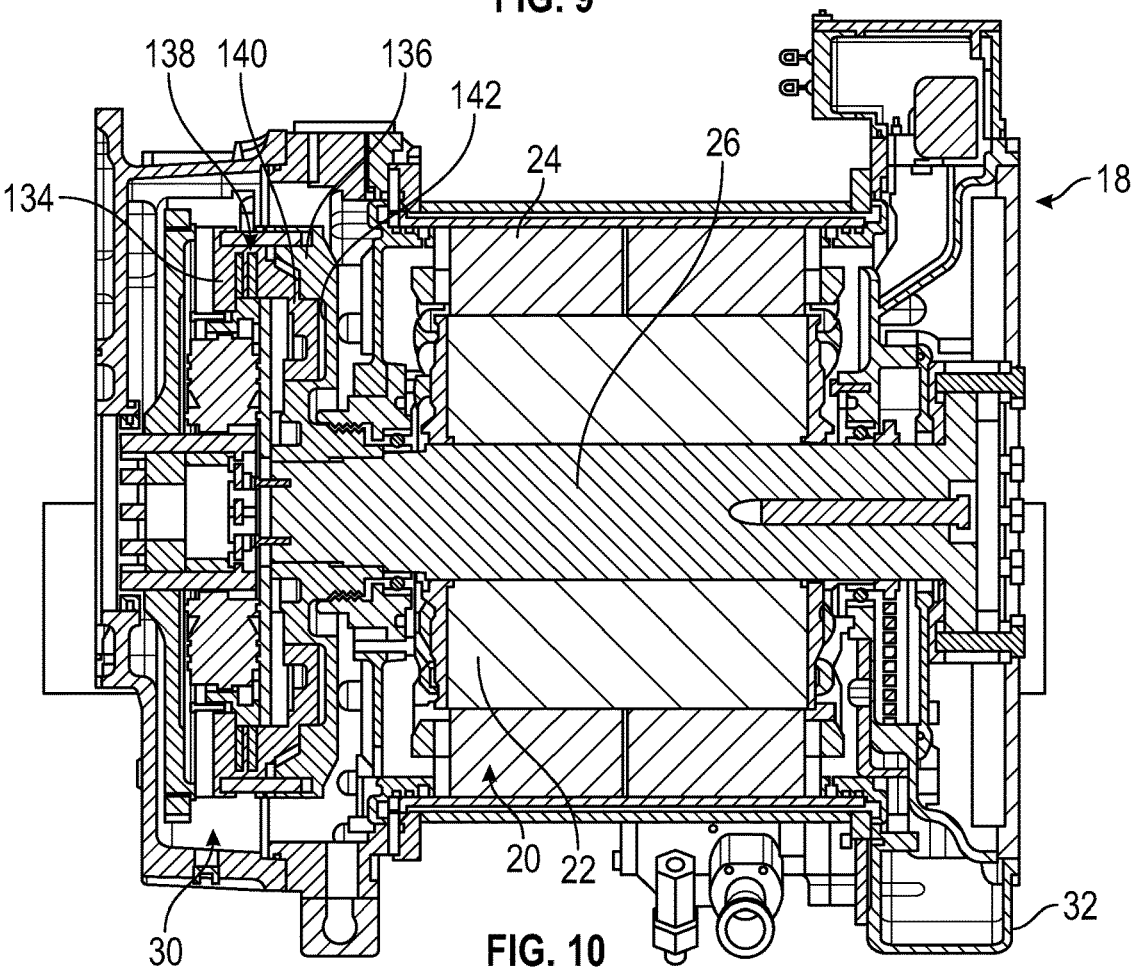
FIG. 10 is a sectioned side diagrammatic view of an electric motor assembly, according to one embodiment.

Still referring to the drawings generally, but also now to FIG. 10, there is shown a sectioned side view of electric motor assembly 18 illustrating additional features and details thereof. As depicted in FIG. 10, disconnect clutch 30 may include a first rotatable component 134 structured to rotate with engine output shaft 16, and a second rotatable component structured to rotate with driveshaft 26. Clutch 30 also includes clutch friction elements 138, and a piston 140 exposed to a fluid pressure of a clutch actuation fluid cavity 142. Varying a pressure of the clutch actuation fluid supplied to fluid cavity 142 can engage or disengage clutch friction elements 138 and rotatably couple or de-couple first rotatable component 134 and second rotatable 136.

The capability to selectively couple engine output shaft 16 to driveshaft 26 enables several different operating modes of propulsion system 12 as suggested above. In an embodiment, propulsion system 12 can be operated in an engine-only mode, a motor-only mode, and a hybrid mode. Electric motor 20 may in some embodiments operate as a motor-generator unit, or MGU, enabling rotation of driveshaft 26 to generate electrical power that can be utilized onboard machine 8 and/or stored in an onboard energy storage device, for example. Engine 14 could be used to rotate electric motor 20 or electric motor 20 regeneratively rotated by retarding machine 8.

In an embodiment, operating propulsion system 12 can include applying a torque to driveshaft 26 in a motor-only mode of propulsion system 12 while disconnect clutch 30 is disengaged, via energizing stator coils 24 in electric motor 20 to rotate rotor 22 coupled to driveshaft 26. Operating propulsion system 12 may also include engaging disconnect clutch 30 positioned in common housing 32 with electric motor 20 to couple driveshaft 26 to engine output shaft 16. With disconnect clutch 30 engaged, a torque can be applied to driveshaft 26 in an engine-only mode of propulsion system 12 via engine output shaft 16 while stator coils 24 are deenergized. In a hybrid mode, a torque can be applied to driveshaft 26 via energizing stator coils 24 while disconnect clutch 30 is engaged. Final drive 50 may be operated via the torque applied to driveshaft 26 in each of the motor-only, engine-only, and hybrid modes.

It will thus be appreciated that propulsion system 12 can be switched among the modes by engaging or disengaging disconnect clutch 30 by varying a pressure of fluid for actuating disconnect clutch 30 and by selectively energizing coils of stator 24. Torque can be applied to driveshaft 26 with engine 10 alone, with energized stator coils 24 alone, or both. First pump 52 is operated via rotation of driveshaft 26 both while disconnect clutch 30 is engaged and while disconnect clutch 30 is disengaged. Accordingly, fluid for cooling and lubrication is supplied to both electric motor 20 and disconnect clutch 30 based on operating first pump 52 regardless of the particular operating mode of propulsion system 12.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A propulsion system comprising:

an engine shaft;

an engine geartrain;

an electric motor assembly including an electric motor, a driveshaft rotatable via energizing the electric motor, and a disconnect clutch structured to couple the driveshaft to the engine shaft;

a fluid system including a first pump driven via a rotation of the driveshaft and having a first pump outlet, a cooling and lubrication fluid circuit fluidly connected to the first pump, a second pump driven via a rotation of the engine geartrain and having a second pump outlet, and a clutch actuation fluid circuit fluidly connected to the second pump and arranged to feed a fluid from the second pump outlet to a clutch actuation fluid supply port for the disconnect clutch; and the fluid system further including an interconnect fluidly connecting the cooling and lubrication fluid circuit to the clutch actuation fluid circuit and arranged to feed the fluid from the cooling and lubrication fluid circuit and the first pump outlet, to the clutch actuation fluid circuit at a location that is fluidly between the second pump outlet and the clutch actuation fluid supply port, based on operating the first pump when the second pump is turned off;

wherein the interconnect is further arranged to feed the fluid, at least at times, from the clutch actuation fluid circuit to the cooling and lubrication fluid circuit when the second pump is turned on;

wherein the first pump is arranged in the cooling and lubrication fluid circuit, and the second pump is arranged in the clutch actuation fluid circuit; and wherein the electric motor assembly further includes a takeoff geartrain fixed to rotate with the driveshaft, and the first pump is rotated via the takeoff geartrain.

2. The system of claim 1 wherein the electric motor assembly further includes a housing wherein each of the electric motor, the disconnect clutch, and the takeoff geartrain is positioned, and the first pump is mounted on the housing.

3. The system of claim 2 wherein the fluid system further includes a common fluid sump mounted on the housing, and each of the cooling and lubrication fluid circuit and the clutch actuation fluid circuit includes a suction conduit fluidly connected to the common fluid sump.

4. The system of claim 1 wherein the fluid system further includes a valve block mounted on the housing and forming the interconnect.

5. The system of claim 4 wherein the cooling and lubrication fluid circuit further includes a conduit mounted on the housing and fluidly connected between the first pump and the valve block.

6. The system of claim 4 wherein:

the housing includes a clutch housing component, a geartrain housing component, and a motor housing component attached between the clutch housing component and the geartrain housing component; and the first pump is mounted on the geartrain housing component, and the valve block is mounted on the clutch housing component.

7. A method of cooling and lubricating a propulsion system comprising:

applying a torque to a driveshaft of an electric motor via a disconnect clutch engaged between the electric motor and an engine;

disengaging the disconnect clutch via varying a pressure of a fluid for actuating the disconnect clutch supplied from an actuation fluid pump driven via the engine;

shutting down the engine such that the actuation fluid pump is not operated;

applying a torque to the driveshaft via energizing stator coils in the electric motor while the disconnect clutch is disengaged;

operating a cooling and lubrication fluid pump via rotation of the driveshaft both while the disconnect clutch is engaged and while the disconnect clutch is disengaged; and supplying a fluid for cooling and lubrication to the electric motor and to the disconnect clutch based on the operating of the cooling and lubrication fluid pump while the engine is shut down such that the actuation fluid pump is not operated and the disconnect clutch is disengaged;

wherein the supplying the fluid for cooling and lubrication includes supplying the fluid via an interconnect from a cooling and lubrication fluid circuit to a clutch actuation fluid circuit and to the disconnect clutch without feeding the fluid through the actuation fluid pump; and supplying the fluid via the interconnect from the clutch actuation fluid circuit to the cooling and lubrication fluid circuit.

8. The method of claim 7 wherein the cooling and lubrication fluid circuit and the clutch actuation fluid circuit connect to a common fluid sump.

9. The method of claim 7 wherein the interconnect is formed by a valve block mounted on a housing for the electric motor and the disconnect clutch.

10. The method of claim 9 wherein the supplying fluid for cooling and lubrication further includes supplying fluid from a geartrain housing component to a clutch housing component.

11. The method of claim 10 wherein the housing includes a motor housing component attached between the geartrain housing component and the clutch housing component, and the supplying fluid for cooling and lubrication further includes supplying the fluid via a conduit attached externally to the geartrain housing component and to the clutch housing component.

12. The method of claim 7 further comprising operating the actuation fluid pump via an engine geartrain of the engine.

13. A propulsion system comprising:

an electric motor assembly including at least one housing forming a first fluid supply port, an actuation fluid supply port, at least one drain, an electric motor having a driveshaft, and a disconnect clutch;

an engine geartrain;

a fluid system including a cooling and lubrication fluid circuit fluidly connected to a first pump driven via the electric motor, and a clutch actuation fluid circuit fluidly connect to a second pump driven via the engine geartrain;

the cooling and lubrication fluid circuit including a first pump outgoing conduit arranged to supply cooling and lubrication fluid from the first pump into the at least one housing via the first fluid supply port, and a first pump supply conduit;

the clutch actuation fluid circuit including a second pump outgoing conduit arranged to supply clutch actuation fluid from the second pump into the at least one housing via the actuation fluid supply port, and a second pump supply conduit;

the cooling and lubrication fluid circuit is fluidly connected to the clutch actuation fluid circuit via an interconnect arranged to feed a flow of fluid from the first pump outgoing conduit into the at least one housing via the actuation fluid supply port when the second pump is not driven via the engine geartrain and turned off, and to feed a flow of fluid from the second pump outgoing conduit into the at least one housing via the first fluid supply port, at least at times, when the second pump is driven via the engine geartrain and turned on; and a one-piece valve block mounted on the at least one housing, and forming the interconnect fluidly connecting the respective pump outgoing conduits, such that the cooling and lubrication fluid circuit and the clutch actuation fluid circuit are fluidly connected within the valve block.

14. The system of claim 13 further comprising the first pump onboard the electric motor assembly, and the second pump offboard the electric motor assembly.

15. The system of claim 14 wherein the electric motor assembly further includes a takeoff geartrain, and the first pump is rotated via the takeoff geartrain.

16. The system of claim 13 further comprising a common fluid sump fluidly connecting the respective pump supply conduits.

* * * * *